US007645130B2

(12) United States Patent
Sekiya et al.

(10) Patent No.: US 7,645,130 B2
(45) Date of Patent: Jan. 12, 2010

(54) SCROLL COMPRESSOR WITH AN ORBITING SCROLL AND TWO FIXED SCROLLS AND RING AND TIP SEALS

(75) Inventors: Shin Sekiya, Tokyo (JP); Masayuki Kakuda, Tokyo (JP); Toshihide Koda, Tokyo (JP); Toshiyuki Nakamura, Tokyo (JP); Kunio Tojo, Tokyo (JP); Kenji Yano, Tokyo (JP); Masaaki Sugawa, Tokyo (JP); Fumihiko Ishizono, Tokyo (JP); Masahiro Sugihara, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 245 days.

(21) Appl. No.: 11/816,944

(22) PCT Filed: Jan. 30, 2006

(86) PCT No.: PCT/JP2006/301449

§ 371 (c)(1),
(2), (4) Date: Aug. 23, 2007

(87) PCT Pub. No.: WO2006/103824

PCT Pub. Date: Oct. 5, 2006

(65) Prior Publication Data

US 2008/0193313 A1 Aug. 14, 2008

(30) Foreign Application Priority Data

Mar. 28, 2005 (JP) ..... 2005-091113

(51) Int. Cl.
*F04C 18/02* (2006.01)
*F01C 1/02* (2006.01)

(52) U.S. Cl. ..... 418/55.4; 418/60; 418/142

(58) Field of Classification Search ..... 418/55.1, 418/55.4, 56, 60, 104, 142
See application file for complete search history.

(56) References Cited

U.S. PATENT DOCUMENTS

| | | | | |
|---|---|---|---|---|
| 4,515,539 | A * | 5/1985 | Morishita | 418/55.1 |
| 5,035,589 | A * | 7/1991 | Fraser et al. | 418/55.4 |
| 5,616,015 | A * | 4/1997 | Liepert | 418/60 |
| 6,149,405 | A * | 11/2000 | Abe et al. | 418/55.2 |
| 6,658,866 | B2 * | 12/2003 | Tang et al. | 418/60 |
| 7,128,528 | B2 | 10/2006 | Takayasu et al. | |
| 2003/0000238 | A1 * | 1/2003 | Uchida et al. | 62/323.4 |

FOREIGN PATENT DOCUMENTS

| | | |
|---|---|---|
| JP | 3-104194 U | 10/1991 |
| JP | 3-237202 A1 | 10/1991 |

(Continued)

*Primary Examiner*—Thomas E Denion
*Assistant Examiner*—Mary A Davis
(74) *Attorney, Agent, or Firm*—Leydig, Voit & Mayer, Ltd.

(57) ABSTRACT

A scroll compressor that has reduced leakage loss and high efficiency includes an orbiting scroll that has spiral teeth on two surfaces, and a fixed scrolls that face the surfaces of the orbiting scroll and that have spiral teeth that intermesh with the spiral of the orbiting scroll. Tip seals are mounted only to a spiral tooth of one of the fixed scrolls that intermeshes with a spiral tooth of the orbiting scroll and a spiral tooth of the orbiting scroll.

5 Claims, 7 Drawing Sheets

FOREIGN PATENT DOCUMENTS

| | | | | |
|---|---|---|---|---|
| JP | 7-310682 | A1 | | 11/1995 |
| JP | 07310682 | A | * | 11/1995 |
| JP | 9-158853 | A1 | | 6/1997 |
| JP | 9-324770 | A1 | | 12/1997 |
| JP | 2003-314448 | A1 | | 11/2003 |
| JP | 2004-60535 | A1 | | 2/2004 |

* cited by examiner (a)

(b)

SCROLL COMPRESSOR WITH AN ORBITING SCROLL AND TWO FIXED SCROLLS AND RING AND TIP SEALS

TECHNICAL FIELD

The present invention relates to a scroll compressor in which spiral teeth are formed on two surfaces of an orbiting scroll, and relates particularly to a technique that reduces leakage loss in a scroll compressor.

BACKGROUND ART

One example of a scroll compressor is a configuration constituted by: an orbiting scroll having spiral teeth formed on two sides; and a pair of fixed scrolls on which spiral teeth are formed such that the respective spiral teeth intermesh (see Patent Literature 1, for example). Hereinafter, this will be called a "double-sided spiral scroll compressor". In double-sided spiral scroll compressors of this kind, axial thrust loads due to compressed gas cancel each other out because compression chambers are formed on both sides of the orbiting scroll.

On the other hand, because there are two compression chambers in double-sided spiral scroll compressors, they have constructions in which leakage is more likely to occur from a compression side to an intake side, and it is necessary to reduce gaps between the respective spiral teeth and facing base plates in order to reduce leakage loss. However, for the orbiting scroll to move between the two fixed scrolls without being restrained, it is not possible to set the gaps between the respective spiral teeth and the base plates (hereinafter called "spiral tooth tip end gaps") too small when considering assembly precision, etc.

For this reason, leakage from the spiral tooth tip gaps is suppressed in conventional double-sided spiral scroll compressors by disposing grooves in tip end surfaces of the spiral teeth on both sides of the orbiting scroll and in tip end surfaces of the spiral teeth in the two fixed scrolls, respectively, and mounting tip seals in the grooves to achieve reductions in leakage loss (see Patent Literature 2, for example).

In other conventional double-sided spiral scroll compressors, tip seals are divided into two sections vertically and mating surfaces thereof are formed so as to have a saw-teeth form in order to suppress leakage from the spiral tooth tip end gaps (see Patent Literature 3, for example). In such configurations, suppression of leakage is achieved by upper tip seals being raised onto lower tip seals by pressure differences to fill the spiral tooth tip end gaps.

Patent Literature 1: Japanese Patent Laid-Open No. HEI 3-237202 (Gazette: p.9; FIG. 1)

Patent Literature 2: Japanese Patent Laid-Open No. HEI 9-324770 (Gazette: pp.2-3; FIG. 2)

Patent Literature 3: Japanese Patent Laid-Open No. HEI 7-310682 (Gazette)

DISCLOSURE OF THE INVENTION

Problem to be Solved by the Invention

However, in conventional double-sided spiral scroll compressors such as those described above, leakage cannot be suppressed along the spiral teeth from spiral tooth tip end gaps on tip seal side surfaces. In particular because pathways for this leakage exist in two positions in double-sided spiral scroll compressors, that is to say on both sides of the orbiting scroll, one important task has been to try to reduce the leakage loss from the spiral tooth tip end gaps in order to achieve increased performance in double-sided spiral scroll compressors.

The present invention aims to solve the above problems and an object of the present invention is to provide a scroll compressor that has reduced leakage loss and high efficiency.

Means for Solving Problem

In order to achieve the above object, according to one aspect of the present invention, there is provided a scroll compressor including: an orbiting scroll that has spiral teeth on two surfaces; and a pair of fixed scrolls that are installed so as to face the surfaces of the orbiting scroll and that have spiral teeth that intermesh with the spiral teeth of the orbiting scroll, characterized in that tip seals are mounted only to a spiral tooth of the fixed scroll that intermeshes with a first spiral tooth of the orbiting scroll and to the first spiral tooth of the orbiting scroll.

Effects of the Invention

According to the present invention, because an orbiting scroll that has spiral teeth on two surfaces, and a pair of fixed scrolls that are installed so as to face the surfaces of the orbiting scroll and that have spiral teeth that intermesh with the spiral teeth of the orbiting scroll are included, and tip seals are mounted only to a spiral tooth of the fixed scroll that intermeshes with a first spiral tooth of the orbiting scroll and to the first spiral tooth of the orbiting scroll, a scroll compressor that has reduced leakage loss and high efficiency can be provided.

BEST MODE FOR CARRYING OUT THE INVENTION

Embodiment 1

Figure 1:
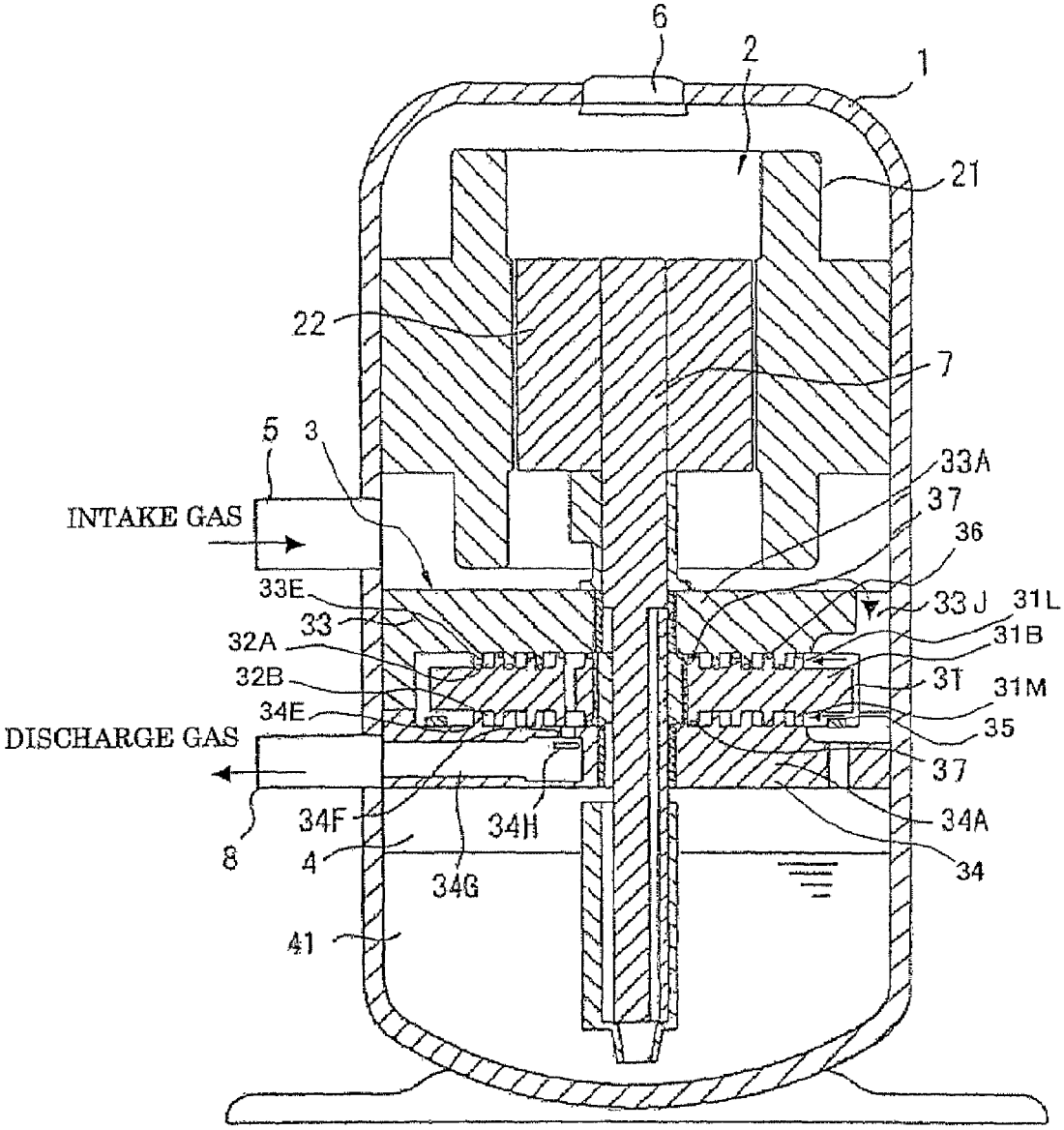
FIG. 1 is a cross section showing a configuration of a scroll compressor according to Embodiment 1 of the present invention.

FIG. 1 is a cross section showing a configuration of a double-sided spiral scroll compressor according to Embodiment 1 of the present invention.

In FIG. 1, a motor 2 is disposed in an upper portion inside a vertical sealed vessel 1, and a compression portion 3 is disposed below the motor 2. A lubricating oil storage chamber 4 for storing lubricating oil 41 is formed further below the compression portion 3. A suction pipe 5 for sucking in gas is disposed on a side surface of the sealed vessel 1 at an intermediate portion between the motor 2 and the compression portion 3, and a discharge pipe 8 for discharging compressed gas is disposed on the compression portion 3. In addition, a glass terminal 6 for supplying electric power is disposed on an upper end of the sealed vessel 1. The motor 2 is constituted by: a stator 21 that is formed so as to have a ring shape; and a rotor 22 that is supported inside the stator 21 so as to be rotatable. A main shaft 7 is fixed to the rotor 22 and passes through the compression portion 3, and an end portion of the main shaft 7 is immersed in the lubricating oil 41 in the lubricating oil storage chamber 4.

The compression portion 3 has: an orbiting scroll 31; an upper fixed scroll 33 and a lower fixed scroll 34 that are installed so as to face two surfaces of the orbiting scroll 31; and a commonly-known Oldham coupling 35 that is disposed between the lower fixed scroll 34 and the orbiting scroll 31. An upper spiral tooth 31L and a lower spiral tooth 31M are disposed on two surfaces of a base plate 31B of the orbiting scroll 31 so as to be symmetrical and also equal in height to each other.

A spiral tooth 33E is disposed on a surface of a base plate 33A of the upper fixed scroll 33 that faces the orbiting scroll 31 so as to intermesh with the upper spiral tooth 31L of the orbiting scroll 31, and the upper spiral tooth 31L of the orbiting scroll 31 and the spiral tooth 33E of the upper fixed scroll 33 form an upper compression chamber 32A. Similarly, a spiral tooth 34E is disposed on a surface of a base plate 34A of the lower fixed scroll 34 that faces the orbiting scroll 31 so as to intermesh with the lower spiral tooth 31M of the orbiting scroll 31, and the lower spiral tooth 31M of the orbiting scroll 31 and the spiral tooth 34E of the lower fixed scroll 34 form a lower compression chamber 32B.

Tip seals 36 are mounted to a tip end surface of the upper spiral tooth 31L of the orbiting scroll 31 and a tip end surface of the spiral tooth 33E of the upper fixed scroll 33. Seal rings 37 are also disposed inside the upper spiral tooth 31L and the lower spiral tooth 31M, respectively, of the orbiting scroll 31 outside the main shaft 7.

Figure 2:
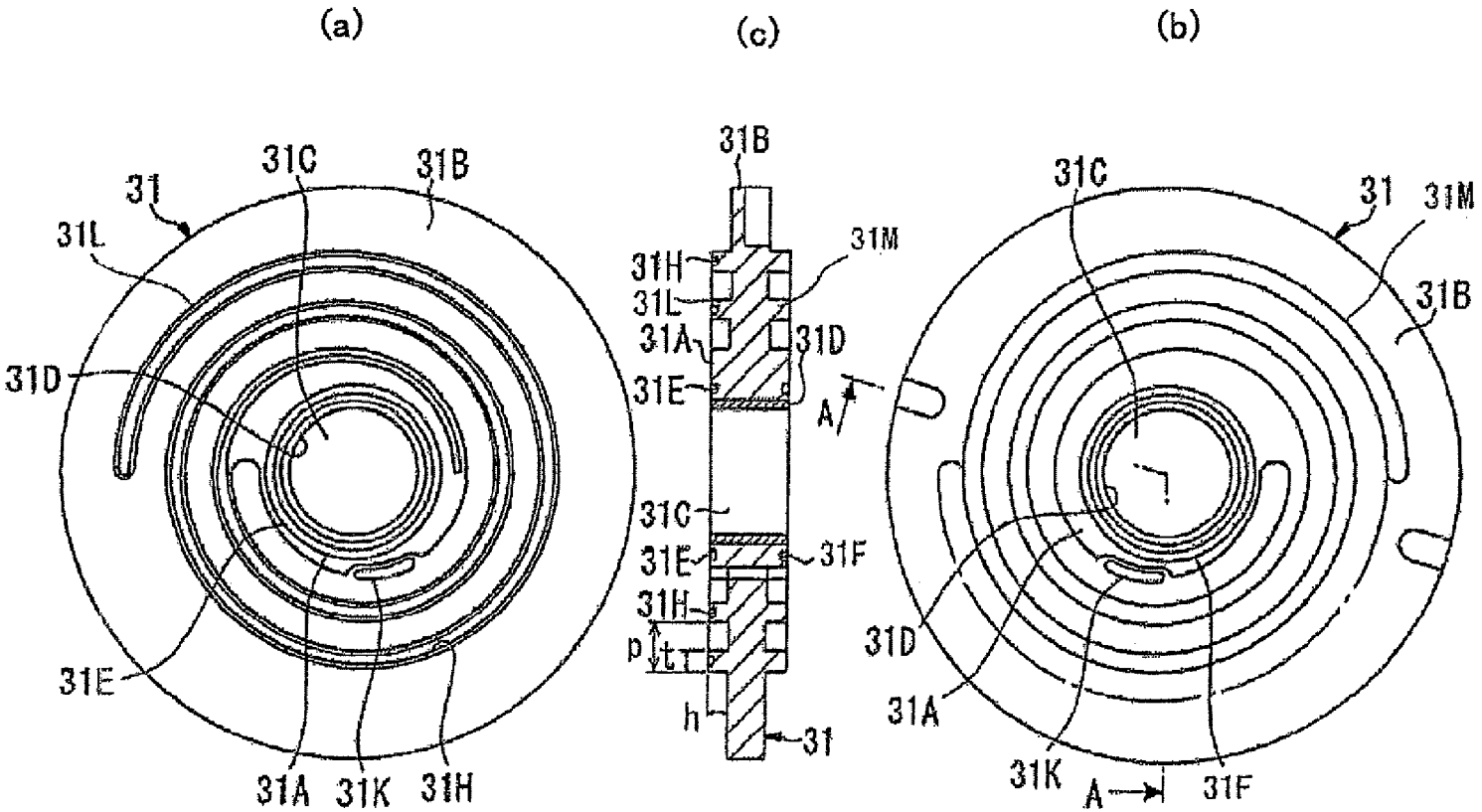
FIG. 2 is a diagram explaining a configuration of an orbiting scroll of the scroll compressor according to Embodiment 1 of the present invention.
Figure 3:
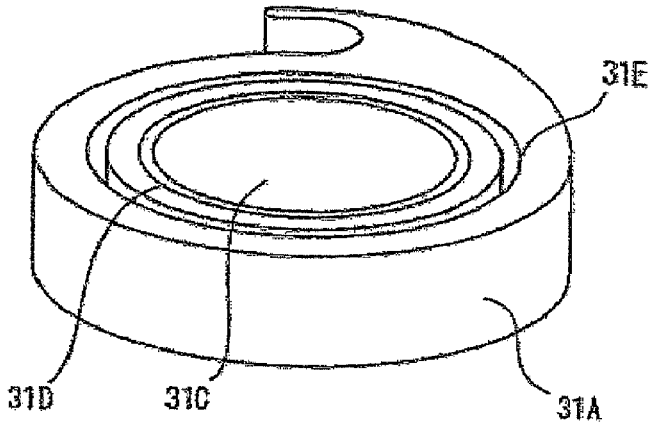
FIG. 3 is a diagram explaining a configuration of a bulb portion that is positioned at a central portion of the orbiting scroll of the scroll compressor according to Embodiment 1 of the present invention.
Figure 3:
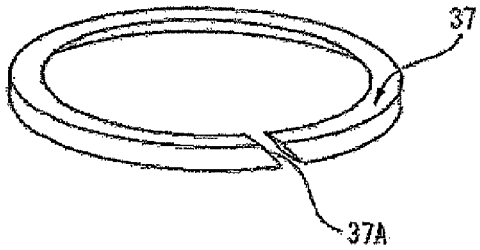

FIG. 2 is a diagram explaining a configuration of an orbiting scroll according to Embodiment 1, FIG. 2(*a*) being a top plan of the orbiting scroll, FIG. 2(*b*) being a bottom plan of the orbiting scroll, and FIG. 2(*c*) being a cross section taken along line A-A in FIG. 2(*b*). FIG. 3 is a diagram explaining a configuration of a bulb portion that is positioned at a central portion of the orbiting scroll, FIG. 3(*a*) being a perspective showing the shape of the bulb portion, and FIG. 3(*b*) being a perspective showing a configuration of seal rings that are installed on an upper surface and a lower surface of the bulb portion. Detailed configuration of the orbiting scroll 31 will now be explained.

As shown in FIGS. 2 and 3(*a*), the orbiting scroll 31 has: a bulb portion 31A that constitutes a central portion and is constituted by curves such as arcs, etc.; and a disk-shaped base plate 31B that extends outside the bulb portion 31A. The upper spiral tooth 31L and the lower spiral tooth 31M, which are symmetrical and are approximately equal in height to the bulb portion 31A, are formed on an upper surface and a lower surface of the base plate 31B by involute curves or arcs. Here, "symmetrical" means configured such that thickness t, height h, pitch p, and number of turns n of the spiral teeth are all equal.

A tip seal groove 31H for mounting a tip seal 36 is formed on the tip end surface of the upper spiral tooth 31L. On the other hand, a tip seal groove 31H for mounting a tip seal 36 is not formed on the tip end surface of the lower spiral tooth 31M.

A main shaft aperture 31C through which the main shaft 7 passes is formed on a central portion of the bulb portion 31A, and an orbiting shaft bearing 31D is disposed on an inner wall thereof An upper seal ring groove 31E and a lower seal ring groove 31F are formed on an outer portion of the orbiting shaft bearing 31D on the upper surface and the lower surface, respectively, of the bulb portion 31A, and seal rings 37 having an abutted joint 37A as shown in FIG. 3(*b*) are installed in the upper seal ring groove 31E and the lower seal ring groove 31F. In addition, a communicating port 31K that connects the upper compression chamber 32A and the lower compression chamber 32B is disposed outside the bulb portion 31A.

Figure 4:
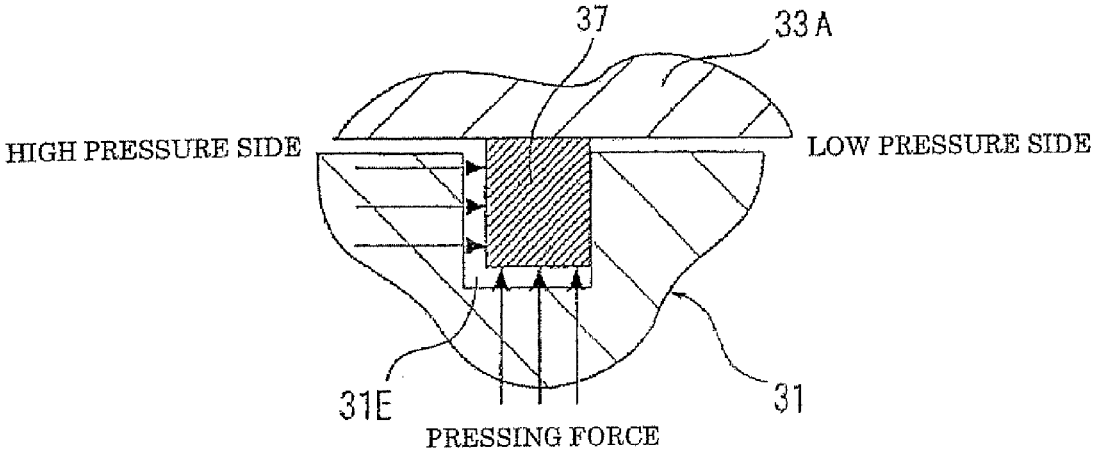
FIG. 4 is a cross section in which a vicinity of a seal ring of the scroll compressor according to Embodiment 1 of the present invention is enlarged.

FIG. 4 is a cross section in which a vicinity of a seal ring is enlarged in order to explain effects of a contact sealing action of the seal rings.

As shown in FIG. 4, the seal ring 37 is pressed from the left and from below, which are on a high-pressure side, as indicated by the arrows, due to differential pressure on two sides of the compression chamber that are partitioned off. For this reason, the seal ring 37 is pressed against a wall to the right of the seal ring groove 31E and the base plate 33A of the fixed scroll 33 above inside the seal ring groove 31E, forming a contact seal between the orbiting scroll 31 and the upper fixed scroll 33. Contact sealing actions of the seal ring 37 are also similar on the lower surface of the orbiting scroll 31, that is, between the orbiting scroll 31 and the lower fixed scroll 34.

A communicating port 31K that merges gas compressed in the upper compression chamber 32A and the lower compression chamber 32B and directs it toward a discharge port 34F on the lower fixed scroll 34 is disposed on the orbiting scroll 31 as shown in FIG. 2. The communicating port 31K is formed so as to pass vertically through the base plate 31B outside the upper seal ring groove 31E and the lower seal ring groove 31F. The communicating port 31K is disposed at a position where it does not span the partitioned compression chambers in the upper spiral tooth 31L or the lower spiral tooth 31M and where it always communicates with the discharge port 34F that is disposed on the lower fixed scroll 34 even during orbital motion.

Figure 5:
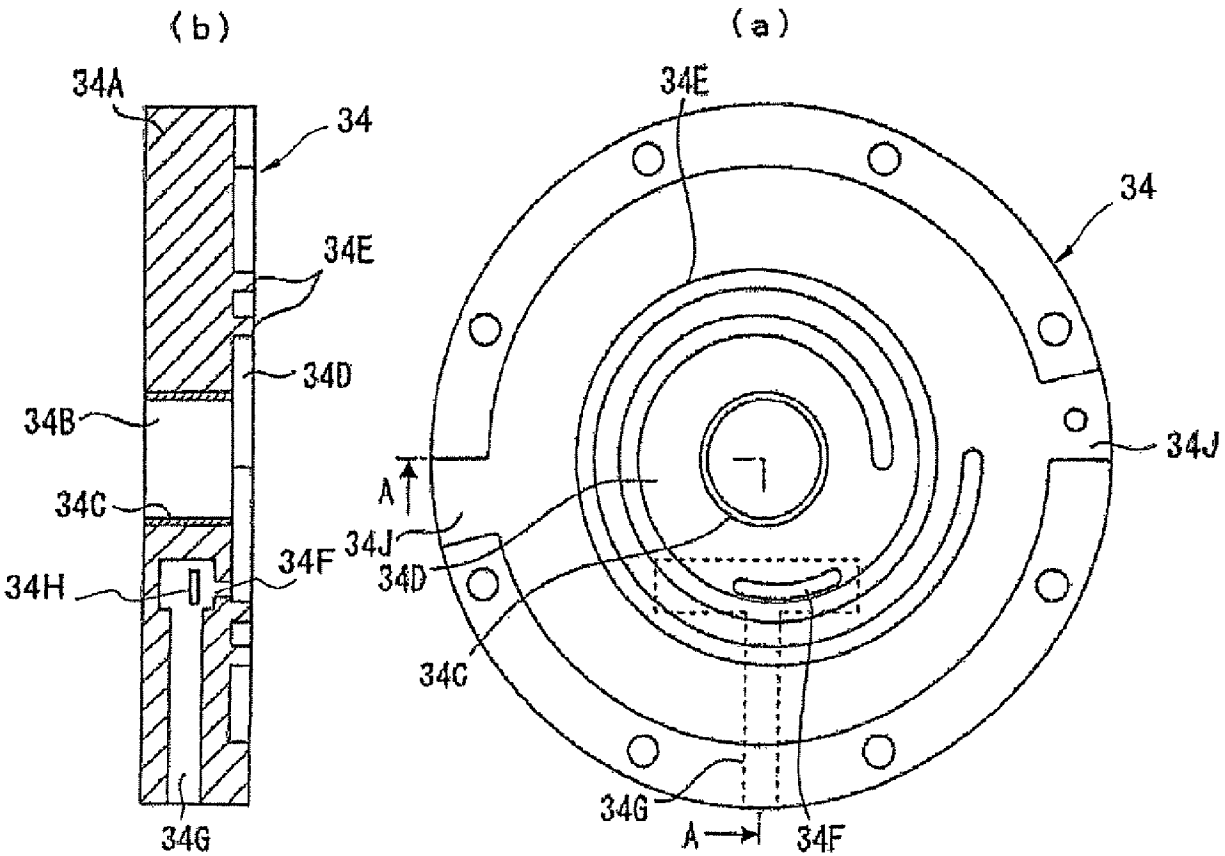
FIG. 5 is a diagram explaining a configuration of a lower fixed scroll of the scroll compressor according to Embodiment 1 of the present invention.

FIG. 5 is a diagram explaining a configuration of a lower fixed scroll, FIG. 5(*a*) being a top plan, and FIG. 5(*b*) being a cross section taken along line A-A in FIG. 5(*a*). Configuration of the lower fixed scroll 34 will now be explained.

As shown in FIG. 5, a main shaft aperture 34B through which the main shaft 7 passes is formed on a central portion of the base plate 34A of the lower fixed scroll 34, and a main shaft bearing 34C is disposed on an inner surface of the main shaft aperture 34B. A recess portion 34D that accommodates the bulb portion 31A of the orbiting scroll 31 and permits orbital motion of the orbiting scroll 31 is formed on an upper surface of the lower fixed scroll 34 at an outer portion of the main shaft bearing 34C. A spiral tooth 34E that has a thickness t, a height h, a pitch p, and number of turns n identical to those of the lower spiral tooth 31M of the orbiting scroll 31 and has a phase rotated by 180 degrees is formed outside the recess portion 34D.

A discharge port 34F for discharging compressed gas is disposed in the recess portion 34D at a position where it does not face the seal ring 37 that is installed on the orbiting scroll 31 and where it always communicates with the communicating port 31K of the orbiting scroll 31. A discharge flow channel 34G that communicates with the discharge port 34F and directs compressed gas to the discharge pipe 8 disposed on the sealed vessel 1 is formed on the lower fixed scroll 34, and a discharge valve 34H for preventing reverse flow of gas is disposed inside the discharge flow channel 34G at a position facing the discharge port 34F. In addition, a suction port 34J that sucks gas into the lower compression chamber 32B is disposed on an outermost portion of the lower fixed scroll 34.

Figure 6:
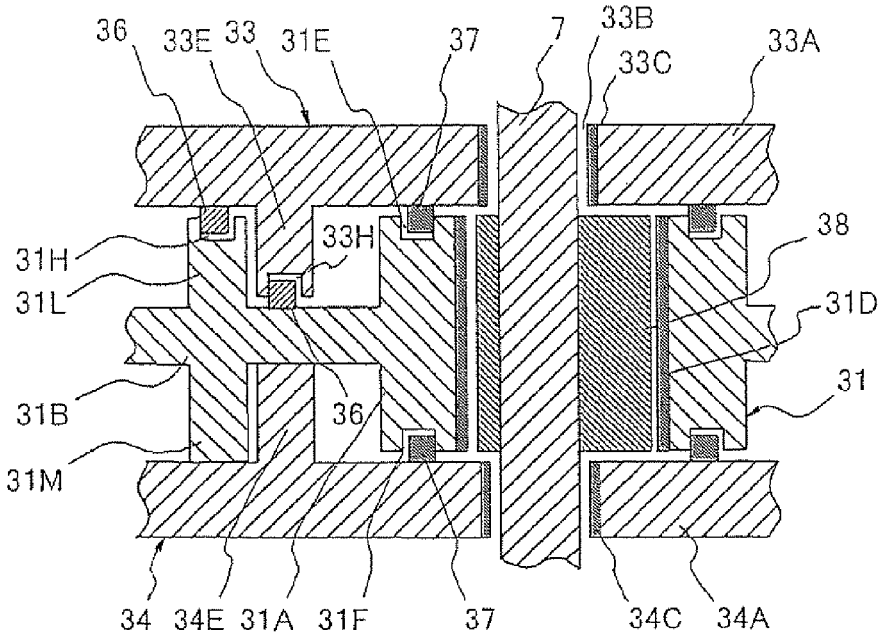
FIG. 6 is a cross section in which a central vicinity of the orbiting scroll of the scroll compressor according to Embodiment 1 of the present invention is enlarged.

FIG. 6 is a cross section in which a central vicinity of the orbiting scroll of the scroll compressor according to Embodiment 1 is enlarged.

In FIG. 6, a main shaft aperture 33B through which the main shaft 7 passes is formed on a central portion of the base plate 33A of the upper fixed scroll 33 in a similar manner to the lower fixed scroll 34 shown in FIG. 5, and a main shaft bearing 33C is disposed on an inner surface of the main shaft aperture 33B. A slider 38 that is fitted onto the main shaft 7 is disposed between the orbiting shaft bearing 31D and the main shaft 7 and, together with the main shaft 7, constitutes an eccentric shaft that drives the orbiting scroll 31 by means of the orbiting shaft bearing 31D. Tip seal grooves 311H and 33H are formed on a tip end surface of the upper spiral tooth 31L of the orbiting scroll 31 and a tip end surface of the spiral tooth 33E of the upper fixed scroll 33, respectively, and tip seals 36 are mounted into each of the tip seal grooves 31H and 33H. On the other hand, tip seal grooves are not formed and tip seals 36 are not mounted to a tip end surface of the lower spiral tooth 31M of the orbiting scroll 31 or to a tip end surface of the spiral tooth 34E of the lower fixed scroll 34.

Operation of a double-sided spiral scroll compressors according to Embodiment 1 of the present invention will now be explained.

As shown in FIG. 1, gas that is sucked inside the sealed vessel 1 through the suction pipe 5 flows into a portion where the motor 2 is installed, and cools the motor 2. The gas that has been sucked in is introduced through a suction port 33J that is disposed on an outer portion of the upper fixed scroll 33 into the upper compression chamber 32A and the lower compression chamber 32B that are formed on the two surfaces of the orbiting scroll 31 as indicated by arrows.

The orbiting scroll 31 orbits relative to the upper fixed scroll 33 and the lower fixed scroll 34 without autorotating, such that the volumes of the crescent-shaped upper compression chamber 32A and lower compression chamber 32B that are formed are gradually reduced toward the center, and the gas is compressed by a commonly-known compression principle. The gas compressed in the upper compression chamber 32A and the lower compression chamber 32B, respectively, merges at the discharge port 34F, passes through the discharge flow channel 34G, and flows out of the sealed vessel 1 through the discharge pipe 8.

Figure 7:
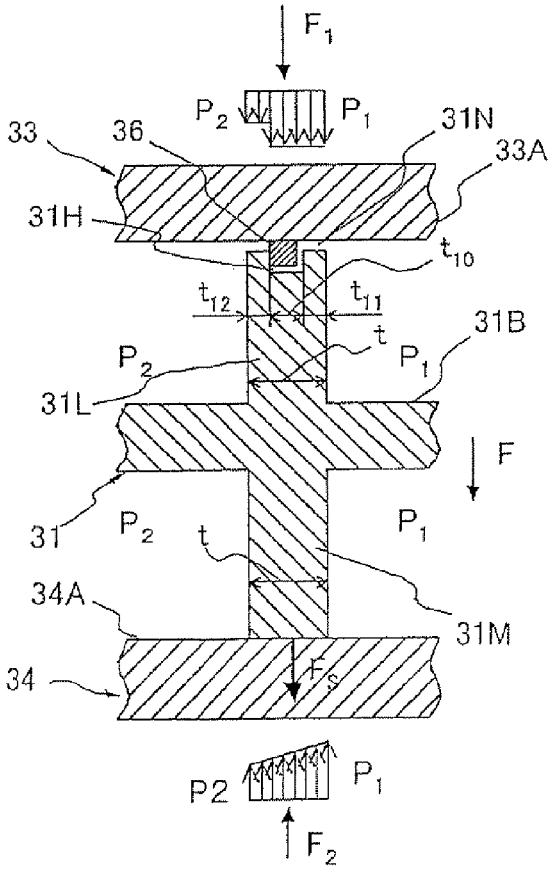
FIG. 7 is a schematic diagram for explaining thrust loads that act on the orbiting scroll in the scroll compressor according to Embodiment 1 of the present invention.

In the above compression process, thrust loads are generated in a thrust direction (axial direction) by the gas compressed by the upper compression chamber 32A and the lower compression chamber 32B, respectively. Magnitude of the thrust loads that act on the orbiting scroll 31 will now be explained. FIG. 7 is a schematic diagram for explaining the thrust loads that act on the orbiting scroll 31.

The tip seal 36 exhibits behavior similar to that of the seal ring 37 shown in FIG. 4, and is pushed from a high-pressure side toward a low-pressure side by differential pressure between compression chambers that are partitioned off on both sides. If we assume that the right side of the upper spiral tooth 31L in FIG. 7 is the high-pressure side (pressure $P_1$), and the left side is the low-pressure side (pressure $P_2$), then the tip seal 36 is pressed from the right and from below, and forms a contact seal inside the tip seal groove 31H by being pressed against a wall of the tip seal groove 31H on the left and the base plate 33A above. Because of this, the pressure $P_1$ on the high-pressure side acts on a bottom surface of the tip seal groove 31H of the orbiting scroll 31 and a spiral tooth inner tip end surface, and the pressure $P_2$ on the low-pressure side acts on a spiral tooth outer tip end surface.

The thrust load F that acts on the orbiting scroll 31 will now be explained. Because the pressure that acts on the upper surface and the pressure that acts on the lower surface are equal in portions of the base plate 31B where there is no upper spiral tooth 31L and no lower spiral tooth 31M, the thrust loads cancel each other out.

However, in portions where the upper spiral tooth 31L and the lower spiral tooth 31M are disposed, the thrust load $F_1$ that acts on the tip end surface of the upper spiral tooth 31L and the thrust load $F_2$ per unit length that acts on the tip end surface of the lower spiral tooth 31M differ from each other. If we let overall thickness of the upper spiral tooth 31L and the lower spiral tooth 31M be t, and width of the outer tip end surface of the upper spiral tooth 31L be $t_{12}$, then thrust load per unit length $F_1$ that acts on the tip end surface of the upper spiral tooth 31L can be expressed by Mathematical Formula 1.

[Mathematical Formula 1]

$$F_1=P_1(t-t_{12})+P_2t_{12} \tag{1}$$

On the other hand, because a pressure that is an average of the pressure $P_1$ on the high-pressure side and the pressure $P_2$ on the low-pressure side acts on the tip end surface of the orbiting scroll lower spiral tooth 31M, on which a tip seal is not disposed, thrust load per unit length $F_2$ that acts on the tip end surface of the lower spiral tooth 31M can be expressed by Mathematical Formula 2.

[Mathematical Formula 2]

$$F_2 = (P_1 + P_2)\frac{t}{2} \tag{2}$$

Consequently, the thrust load per unit length F that acts on the portions of the orbiting scroll 31 where the upper spiral tooth 31L and the lower spiral tooth 31M are disposed can be expressed by Mathematical Formula 3.

[Mathematical Formula 3]

$$F = F_1 - F_2 = (P_1 - P_2)\frac{t - 2t_{12}}{2} \tag{3}$$

Because a width $t_{11}$ of the spiral tooth inner tip end surface and the width $t_{12}$ of the spiral tooth outer tip end surface of the upper spiral tooth 33L are normally equal, if we let a width of the tip seal groove 31H be $t_{10}$, then the thrust load per unit length F that acts on the portions of the orbiting scroll 31 where the upper spiral tooth 31L and the lower spiral tooth 31M are disposed is given by Mathematical Formula 4.

[Mathematical Formula 4]

$$F = (P_1 - P_2)\frac{t_{10}}{2} \tag{4}$$

Consequently, the direction of the thrust load per unit length F that acts on the portions of the orbiting scroll 31 where the upper spiral tooth 31L and the lower spiral tooth 31M are disposed is downward, and because the thrust load acting on the orbiting scroll 31 as a whole is also directed downward, the orbiting scroll 31 is pressed downward and comes into contact with the lower fixed scroll 34. Because of this, a gap between the lower spiral tooth 31M of the orbiting scroll 31 and the base plate 34A of the lower fixed scroll 34 is almost eliminated (a limited gap that results from surface roughness of the lower spiral tooth 31M and the base plate 34A of the lower fixed scroll 34 remains). In contrast to that, a gap between the upper spiral tooth 31L of the orbiting scroll 31 and the base plate 33A of the upper fixed scroll 33 is almost eliminated by the sealing action of the tip seal 36. However, there is a spiral tooth tip end gap 31N at a tip end portion of the upper spiral tooth 31L near a side surface of the tip seal 36, and leakage occurs in a direction parallel to the upper spiral tooth 31L from this spiral tooth tip end gap 31N.

If, on the other hand, the tip seals 36 are mounted to the upper spiral tooth 31L and the lower spiral tooth 31M of the orbiting scroll 31, to the spiral tooth 33E of the upper fixed scroll 33, and to the spiral tooth 34E of the lower fixed scroll 34, leakage occurs on the two surfaces of the orbiting scroll 31 in directions parallel to the upper spiral tooth 31L and the lower spiral tooth 31M, respectively. Consequently, leakage in directions parallel to the spiral teeth can be reduced if the tip seals 36 are mounted only to the upper spiral tooth 31L and the spiral tooth 33E of the upper fixed scroll 33 compared to when the tip seals 36 are mounted to all of the spiral tooth 31L, 31M, 33E, and 34E.

Sliding loss when a tip seal 36 is not mounted and sliding loss when a tip seal 36 is mounted will now be compared. Contact load per unit length in a spiral tooth to which a tip seal 36 is not mounted is a contact load per unit length $F_S$ on the base plate 34A of the lower spiral tooth 31M shown in FIG. 7, and is given by the thrust load per unit length F that acts on the orbiting scroll 31 shown in Mathematical Formula 4.

Figure 8:
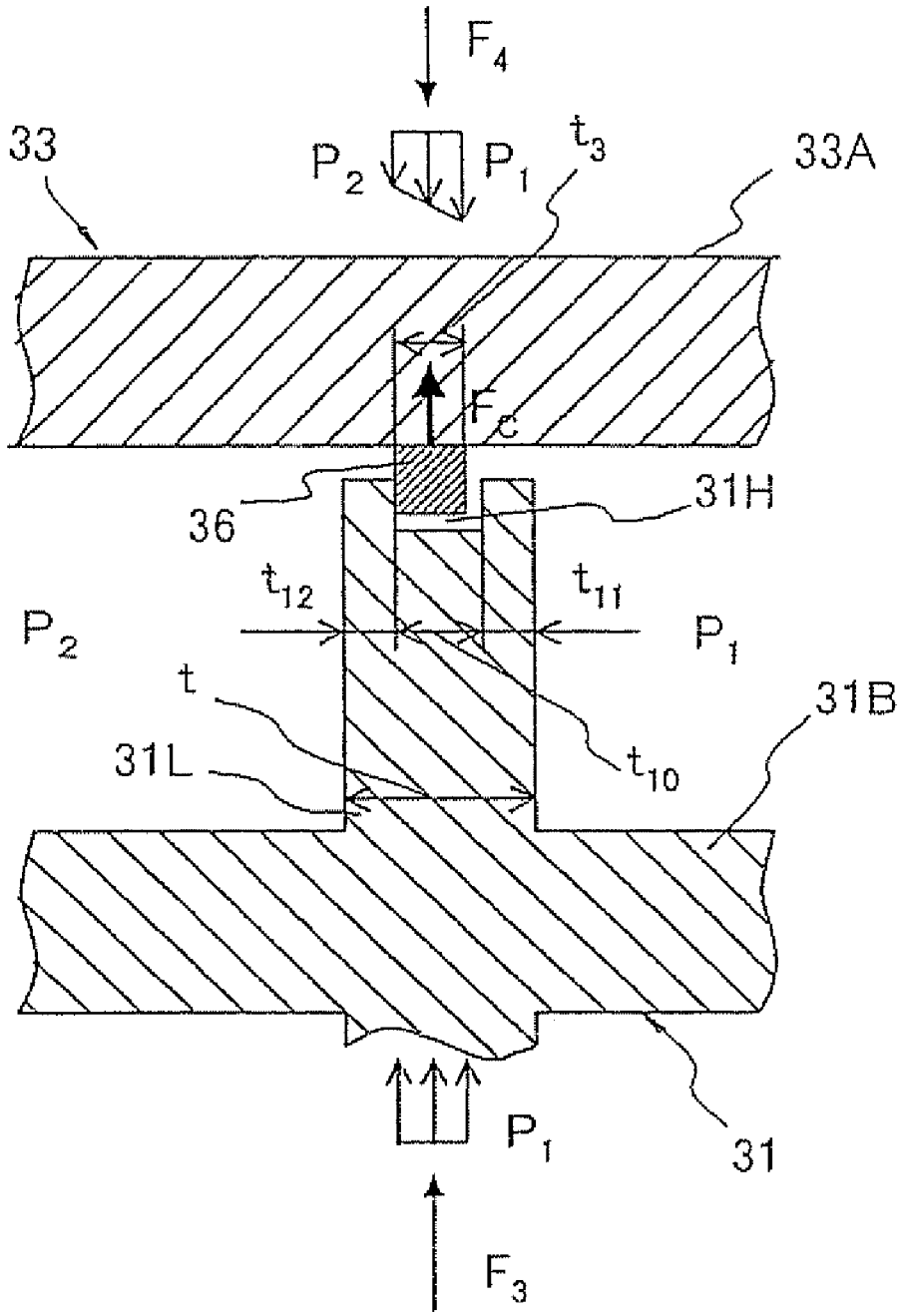
FIG. 8 is a schematic diagram for explaining thrust loads that act on a tip seal in the scroll compressor according to Embodiment 1 of the present invention.

FIG. 8 is a schematic diagram for explaining thrust loads that act on a tip seal. The contact load per unit length on a spiral tooth to which a tip seal is mounted is a contact load per unit length $F_C$ of the tip seal 36 relative to the base plate 33A.

If we let tip seal width be $t_3$, then a thrust load per unit length $F_3$ that pushes the tip seal 36 upward can be expressed by Mathematical Formula 5.

[Mathematical Formula 5]

$$F_3 = P_1 t_3 \tag{5}$$

On the other hand, a thrust load per unit length $F_4$ that pushes the tip seal 36 downward can be expressed by Mathematical Formula 6.

[Mathematical Formula 6]

$$F_4 = (P_1 + P_2)\frac{t_3}{2} \tag{6}$$

Consequently, the contact load per unit length $F_C$ of the tip seal 36 relative to the base plate 33A can be expressed by Mathematical Formula 7.

[Mathematical Formula 7]

$$F_C = F_3 - F_4 = (P_1 - P_2)\frac{t_3}{2} \tag{7}$$

When Mathematical Formula 4 and Mathematical Formula 7 are compared, the contact load per unit length $F_S$ of the lower spiral tooth 31M relative to the base plate 34A and the contact load per unit length $F_C$ of the tip seal 36 relative to the base plate 33A are approximately equal because the width $t_{10}$ of the tip seal groove 31H and the width $t_3$ of the tip seal 36 are approximately equal. Consequently, even if a tip seal 36 is not mounted to a spiral tooth, there is hardly any increase in sliding loss due to contact compared to when a tip seal 36 is mounted to the spiral tooth.

A double-sided spiral scroll compressor according to the present invention and the double-sided spiral scroll compressor that is disclosed as a conventional example in Patent Literature 3 will now be compared. In the double-sided spiral scroll compressor that is disclosed in Patent Literature 3, tip seals are divided into two sections vertically and mating surfaces thereof are formed so as to have a saw-teeth form as a means of reducing gaps in a height direction of spiral teeth on two surfaces. In Patent Literature 3, the upper tip seal is raised on one side by gas pressure and fills the gap in the height direction. As a result, a gap in the height direction is eliminated, and a force is generated in the tip seal that presses the orbiting scroll. In Patent Literature 3, because the orbiting scroll can be pressed by this force, a tip seal is considered unnecessary in the orbiting scroll spiral tooth and the fixed scroll spiral tooth constituting one of the compression chambers.

However, Patent Literature 3 has a complicated configuration in which the tip seals are specifically divided into two sections and mating surfaces thereof are further formed so as to have a saw-teeth form as a means of filling the gap in the height direction and pushing the orbiting scroll against one side. In contrast to that, a double-sided spiral scroll compressor according to the present invention makes use of an effect by which the tip seal rises by gas force and enables the spiral tooth height gap to be eliminated, and it has been found in the present invention for the first time that thrust gas loads that act on the two compression chambers differ from each other depending on the presence or absence of the tip seals, and in addition that this thrust gas load difference acts in such a direction as to push the orbiting scroll toward the compression chamber where there is no tip seal, enabling effects similar to those of Patent Literature 3 to be exhibited using an extremely simple configuration. Since Patent Literature 3 does not make use of the effect by which the tip seal itself rises and enables the spiral tooth height gap to be eliminated, and nor has it found that load differences occur in the thrust gases due to the presence or absence of the tip seals, an extremely complicated configuration must be adopted so as to eliminate the spiral tooth tip end gap and push the orbiting scroll against one side. Dividing the tip seals into two sections and forming mating surfaces thereof so as to have a saw-teeth form increases parts costs, and also makes processes complicated during manufacturing. In addition, by forming the tip seals so as to have a saw-teeth form, cracking is more likely to occur and there is a risk that the tip seals may rupture.

Moreover, in Embodiment 1, tip seals 36 are mounted only to the upper spiral tooth 31L of the orbiting scroll 31 and the spiral tooth 33E of the upper fixed scroll 33, and tip seals are not mounted to the lower spiral tooth 31M of the orbiting scroll 31 or the spiral tooth 34E of the lower fixed scroll 34. However, if tip seals 36 are mounted only to the lower spiral tooth 31M of the orbiting scroll 31 and the spiral tooth 34E of the lower fixed scroll 34 and tip seals 36 are not mounted to the upper spiral tooth 31L of the orbiting scroll 31 or the spiral tooth 33E of the upper fixed scroll 33, leakage in a direction parallel to the spiral teeth can also be similarly reduced compared to when the tip seals 36 are mounted to all of the spiral tooth 31L, 31M, 33E, and 34E.

From the above, it can be seen that by adopting a configuration in which tip seals 36 are mounted only to a first spiral tooth of the orbiting scroll 31 and the spiral tooth of the fixed scroll intermeshing with that spiral tooth and tip seals 36 are not mounted to a second spiral tooth of the orbiting scroll 31 or the spiral tooth of the fixed scroll intermeshing with that spiral tooth, leakage loss can be reduced more in double-sided spiral scroll compressors than when tip seals 36 are mounted to all of the spiral teeth.

Sliding loss when tip seals 36 are mounted only to a first spiral tooth of the orbiting scroll 31 and the spiral tooth of the fixed scroll intermeshing with that spiral tooth and tip seals 36 are not mounted to a second spiral tooth of the orbiting scroll 31 or the spiral tooth of the fixed scroll intermeshing with that spiral tooth hardly increases at all compared to sliding loss when tip seals 36 are mounted to all of the spiral teeth. Because of this, by adopting a configuration in which tip seals 36 are mounted only to a first spiral tooth of the orbiting scroll 31 and the spiral tooth of the fixed scroll intermeshing with that spiral tooth and tip seals 36 are not mounted to a second spiral tooth of the orbiting scroll 31 or the spiral tooth of the fixed scroll intermeshing with that spiral tooth, a double-sided spiral scroll compressor can be obtained that has less leakage loss and higher efficiency than double-sided spiral scroll compressors in which tip seals are mounted to all of the spiral teeth.

In addition, by adopting this kind of construction, material costs and machining costs can be reduced because the quantity of tip seals 36 can be reduced from four to two, and machining positions for the tip seal grooves can also be reduced from four positions to two positions. In addition, because positions for mounting the tip seals 36 can be reduced from four positions to two positions, another advantage arising is that assembly is facilitated.

In Embodiment 1, the width $t_{11}$ of the spiral tooth inner tip end surface was assumed to be equal to the width $t_{12}$ of the spiral tooth outer tip end surface in the upper spiral tooth 31L of the orbiting scroll 31. However, even if the width $t_{11}$ of the spiral tooth inner tip end surface and the width $t_{12}$ of the spiral tooth outer tip end surface of the upper spiral tooth 31L of the orbiting scroll 31 are not equal, it can be seen that from Mathematical Formula 3 that the thrust load F will be directed downward if $t-2t_{12}>0$.

Consequently, by mounting the tip seals 36 only to a first spiral tooth of the orbiting scroll 31 and the spiral tooth of the fixed scroll intermeshing with that spiral tooth, and reducing the width of the outer tip end surface to less than half the spiral tooth thickness t in the spiral tooth mounted with a tip seal 36, a double-sided spiral scroll compressor can be obtained that has less leakage loss and higher efficiency than double-sided spiral scroll compressors in which tip seals are mounted to all of the spiral teeth.

In Embodiment 1, the heights h of the upper spiral tooth 31L and the lower spiral tooth 31M of the orbiting scroll 31, the spiral tooth 33E of the upper fixed scroll 33, and the spiral tooth 34E of the lower fixed scroll 34 are all assumed to be equal. However, the heights of the upper spiral tooth 31L and the lower spiral tooth 31M may also differ from each other provided that the heights of the upper spiral tooth 31L and the spiral tooth 33E of the upper fixed scroll 33 are equal and the heights of the lower spiral tooth 31M and the spiral tooth 34E of the lower fixed scroll 34 are equal,.

In addition, because working pressure is high and the influence of leakage from the spiral tooth tip end gaps is increased if carbon dioxide is used for the gas that is compressed in Embodiment 1, leakage loss can be reduced greatly and effects improving efficiency can be further increased by mounting tip seals only to a first spiral tooth of the orbiting scroll 31 and the spiral tooth of the fixed scroll intermeshing with that spiral tooth in the double-sided spiral scroll compressor.

Embodiment 1 of the present invention is configured such that the pressure inside the sealed vessel 1 that accommodates the orbiting scroll 31, the upper fixed scroll 33, and the lower fixed scroll 34 is equal to an intake pressure of the gas. However, the present invention may also be configured such that the pressure inside the sealed vessel 1 is equal to a discharge pressure of the gas. If configured such that the pressure inside the sealed vessel 1 is equal to the discharge pressure of the gas, it is necessary to dispose the seal rings 37 outside the upper spiral tooth 31L and the lower spiral tooth 31M of the orbiting scroll 31.

Embodiment 2

Figure 9:
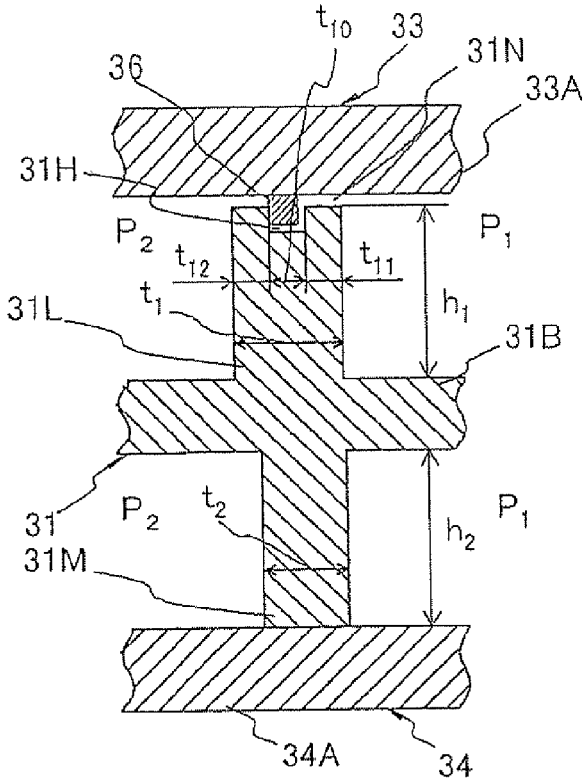
FIG. 9 is a cross section in which an orbiting scroll of a scroll compressor according to Embodiment 2 of the present invention is enlarged.

FIG. 9 is a cross section in which an orbiting scroll of a scroll compressor shown in Embodiment 2 is enlarged. In Embodiment 1, shapes of the upper spiral tooth 31L and the lower spiral tooth 31M of the orbiting scroll 31 are configured symmetrically. In Embodiment 2, number of turns n and orbiting radius r of an upper spiral tooth 31L and a lower spiral tooth 31M are made identical, and a thickness $t_1$ of the upper spiral tooth 31L, to which a tip seal 36 is mounted, is made greater than a thickness $t_2$ of the lower spiral tooth 31M. Here, the orbiting radius r can be expressed by Mathematical Formula 8 using thickness t and pitch p of the spiral teeth.

[Mathematical Formula 8]

$$r = \frac{p}{2} - t \tag{8}$$

Consequently, because the orbiting radii r of the upper spiral tooth 31L and the lower spiral tooth 31M are equal, and the thickness $t_1$ of the upper spiral tooth 31L is greater than the thickness $t_2$ of the lower spiral tooth 31M, the pitch $p_1$ of the upper spiral tooth 31L is greater than the pitch $p_2$ of the lower spiral tooth 31M. Thickness t, height h, pitch p, and number of turns n in a spiral tooth 33E of an upper fixed scroll 33 are all equal to those of the upper spiral tooth 31L of the orbiting scroll 31, and the phase thereof is rotated by 180 degrees. Similarly, thickness t, height h, pitch p, and number of turns n in a spiral tooth 34E of a lower fixed scroll 34 are all equal to those of the lower spiral tooth 31M of the orbiting scroll 31, and the phase thereof is rotated by 180 degrees. The rest of the configuration is similar to the scroll compressor shown in Embodiment 1, and identical numbering has been allocated to parts identical to those of Embodiment 1.

Because the thickness $t_1$ and the pitch $p_1$ of the upper spiral tooth 31L of the orbiting scroll 31, to which a tip seal 36 is mounted, are greater than the thickness $t_2$ and the pitch $p_2$ of the lower spiral tooth 31M, to which a tip seal 36 is not mounted, cross-sectional area of the compression chambers in a direction perpendicular to the main shaft 7 is greater in the upper compression chamber 32A that is constituted by the orbiting scroll 31 and the upper fixed scroll 33 than in the lower compression chamber 32B that is constituted by the orbiting scroll 31 and the lower fixed scroll 34. Thus, because the thrust load $F_1$ is increased and the thrust load F that acts on the orbiting scrolls is increased, the gap between the lower spiral tooth 31M and the base plate 34A of the lower fixed scroll 34 is further reduced, enabling leakage loss to be further reduced, and enabling a highly-efficient scroll compressor to be obtained.

By disposing a means of applying a thrust load to the orbiting scroll 31 in the above manner from a fixed scroll to which a tip seal 36 is mounted toward a fixed scroll to which a tip seal 36 is not mounted, leakage loss can be further reduced, enabling a highly-efficient scroll compressor to be obtained.

In Embodiment 2, a height hi of the upper spiral tooth 31L and a height $h_2$ of the lower spiral tooth 31M are assumed to be equal, but the height $h_1$ of the upper spiral tooth 31L and the height $h_2$ of the lower spiral tooth 31M may also be made to differ from each other such that radial load becomes equal.

Embodiment 3

In Embodiment 1, shapes of the upper spiral tooth 31L and the lower spiral tooth 31M of the orbiting scroll 31 are configured symmetrically. In Embodiment 3, a thickness t, pitch p, and orbiting radius r of an upper spiral tooth 31L and a lower spiral tooth 31M are made identical, and the number of turns $n_1$ in the upper spiral tooth 31L, to which a tip seal 36 is mounted, is made greater than the number of turns $n_2$ in the lower spiral tooth 31M, to which a tip seal is not mounted.

Thickness t, height h, pitch p, and number of turns n in a spiral tooth 33E of an upper fixed scroll 33 are all equal to those of the upper spiral tooth 31L of the orbiting scroll 31, and the phase thereof is rotated by 180 degrees. Similarly, thickness t, height h, pitch p, and number of turns n in a spiral tooth 34E of a lower fixed scroll 34 are all equal to those of the upper spiral tooth 31L of the orbiting scroll 31, and the phase thereof is rotated by 180 degrees. The rest of the configuration is similar to the scroll compressor shown in Embodiment 1, and identical numbering has been allocated to parts identical to those of Embodiment 1.

By making the number of turns $n_1$ in the upper spiral tooth 31L of the orbiting scroll 31, to which a tip seal 36 is mounted, greater than the number of turns $n_2$ in the lower spiral tooth 31M, to which a tip seal 36 is not mounted, cross-sectional area of the compression chambers in a direction perpendicular to the main shaft 7 becomes greater in the upper compression chamber 32A that is constituted by the orbiting scroll 31 and the upper fixed scroll 33 than in the lower compression chamber 32B that is constituted by the orbiting scroll 31 and the lower fixed scroll 34. Thus, because the thrust load $F_1$ is increased and the thrust load F that acts on the orbiting scrolls is increased, the gap between the lower spiral tooth 31M and the base plate 34A of the lower fixed scroll 34 is further reduced, enabling leakage loss to be further reduced, and enabling a highly-efficient double-sided spiral scroll compressor to be obtained.

By disposing a means of applying a thrust load to the orbiting scroll 31 in the above manner from a fixed scroll to which a tip seal 36 is mounted toward a fixed scroll to which a tip seal 36 is not mounted, leakage loss can be further reduced, enabling a highly-efficient scroll compressor to be obtained.

In Embodiment 3, a height $h_1$ of the upper spiral tooth 31L and a height $h_2$ of the lower spiral tooth 31M are assumed to be equal, but the height $h_1$ of the upper spiral tooth 31L and the height $h_2$ of the lower spiral tooth 31M may also be made to differ from each other such that radial load becomes equal.

Embodiment 4

In Embodiment 2, the orbiting radius r and the number of turns n in the upper spiral tooth 31L and the lower spiral tooth 31M of the orbiting scroll 31 were equal, and the thickness t and the pitch p were greater in the upper spiral tooth 31L than in the lower spiral tooth 31M. In Embodiment 3, the orbiting radius r, thickness t, and pitch p in the upper spiral tooth 31L and the lower spiral tooth 31M of the orbiting scroll 31 were equal, and the number of turns n were greater in the upper spiral tooth 31L than in the lower spiral tooth 31M.

In Embodiment 4, an orbiting radius r of an upper spiral tooth 31L and a lower spiral tooth 31M of an orbiting scroll 31 are equal, thickness t and pitch p are greater in the upper spiral tooth 31L than in the lower spiral tooth 31M, and the number of turns n is greater in the upper spiral tooth 31L than in the lower spiral tooth 31M.

By making the thickness t and the pitch p greater in the upper spiral tooth 31L of the orbiting scroll 31, to which a tip seal 36 is mounted, than in the lower spiral tooth 31M, to which a tip seal 36 is not mounted, and making the number of turns n greater in the upper spiral tooth 31L than in the lower spiral tooth 31M, cross-sectional area of the compression chambers in a direction perpendicular to the main shaft 7 becomes greater in the upper compression chamber 32A that is constituted by the orbiting scroll 31 and the upper fixed scroll 33 than in the lower compression chamber 32B that is constituted by the orbiting scroll 31 and the lower fixed scroll 34. For this reason, thrust load $F_1$ is increased and thrust load F that acts on the orbiting scrolls is increased. Thus, the gap between the lower spiral tooth 31M and the base plate 34A of the lower fixed scroll 34 is further reduced, enabling leakage loss to be further reduced, and enabling a highly-efficient double-sided spiral scroll compressor to be obtained.

By disposing a means of applying a thrust load to the orbiting scroll 31 in the above manner from a fixed scroll to which a tip seal 36 is mounted toward a fixed scroll to which a tip seal 36 is not mounted, leakage loss can be further reduced, enabling a highly-efficient scroll compressor to be obtained.

Embodiment 5

Figure 10:
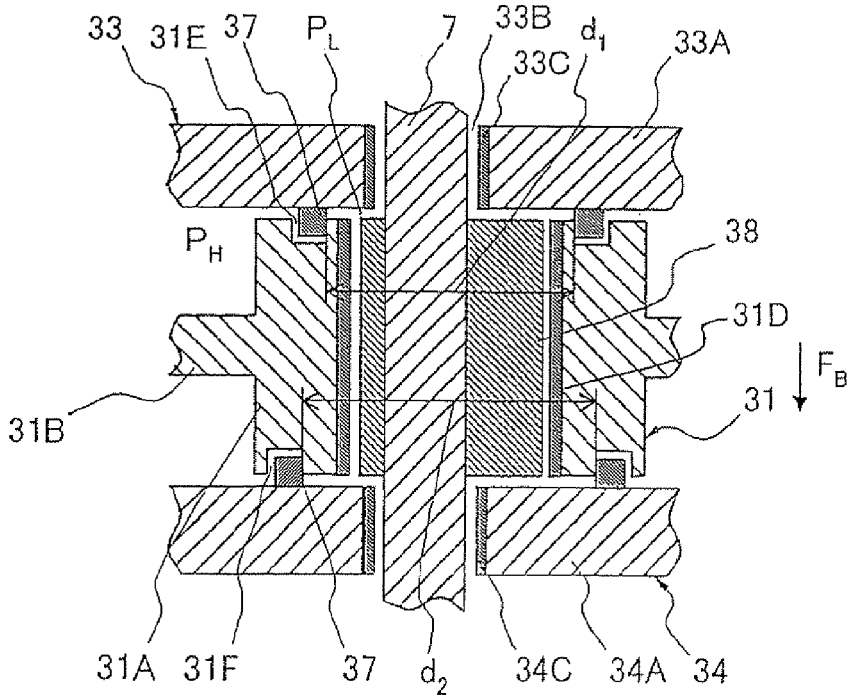
FIG. 10 is a cross section in which a central vicinity of an orbiting scroll of a scroll compressor according to Embodiment 5 of the present invention is enlarged.

FIG. 10 is a cross section in which a central vicinity of an orbiting scroll 31 of a double-sided spiral scroll compressor shown in Embodiment 5 is enlarged. In Embodiment 1, an inside diameter of the upper seal ring groove 31E and an inside diameter of the lower seal ring groove 31F of the orbiting scroll 31 were assumed to be equal. In Embodiment 5, an inside diameter $d_1$ of an upper seal ring groove 31E of an orbiting scroll 31 is smaller than an inside diameter $d_2$ of a lower seal ring groove 31F. The rest of the configuration is similar to the scroll compressor shown in Embodiment 1, and identical numbering has been allocated to identical parts.

A thrust load $F_B$ that acts on the bulb portion 31A of the orbiting scroll 31 will now be explained. Embodiment 5 of the present invention is configured such that the pressure inside the sealed vessel 1 is equal to the intake pressure of the gas. For this reason, a pressure $P_H$ on an outer portion of the bulb portion 31SA is greater than a pressure $P_L$ on an inner portion. Here, the thrust load $F_B$ that acts on the bulb portion 31A can be expressed by Mathematical Formula 9.

[Mathematical Formula 9]

$$F_B = \frac{\pi}{4}(P_H - P_L)(d_2^2 - d_1^2) \quad (9)$$

As indicated by Mathematical Formula 9, if the inside diameter $d_1$ of the upper seal ring groove 31E and the inside diameter $d_2$ of the lower seal ring groove 31F of the orbiting scroll 31 are equal, the thrust load $F_B$ that acts on the bulb portion 31A is canceled out completely. However, when the inside diameter $d_1$ of the upper seal ring groove 31E of the orbiting scroll 31 is smaller than the inside diameter $d_2$ of the lower seal ring groove 31F, as in a scroll compressor according to Embodiment 5, the thrust load $F_B$ that acts on the bulb portion 31A is directed downward, increasing the thrust load F that acts on the orbiting scroll.

Because of this, the gap between the base plate 34A of the lower spiral tooth 31M and the lower fixed scroll 34 is further reduced. Consequently, by making the seal ring groove 31E on the surface on which the spiral tooth 31L is disposed, to which a tip seal 36 is mounted, have an inside diameter $d_1$ that is less than the inside diameter $d_2$ of the seal ring groove 31F on the surface on which the spiral tooth 31M is disposed, to which a tip seal 36 is not mounted, leakage loss can be further reduced, enabling a highly-efficient double-sided spiral scroll compressor to be obtained.

By disposing a means of applying a thrust load to the orbiting scroll 31 in the above manner from a fixed scroll to which a tip seal 36 is mounted toward a fixed scroll to which a tip seal 36 is not mounted, leakage loss can be further reduced, enabling a highly-efficient scroll compressor to be obtained.

In Embodiment 5, because it is sufficient to make the shapes of all of the spiral tooth equal, and only make the inside diameter $d_1$ of the upper seal ring groove 31E of the orbiting scroll 31 less than the inside diameter $d_2$ of the lower seal ring groove 31F, one advantage is that machining is easier than for the scroll compressors shown in Embodiments 2 through 4.

In Embodiment 5, the upper seal ring groove 31E and the lower seal ring groove 31F are disposed on the bulb portion 31A of the orbiting scroll 31. However, the upper seal ring groove 31E and the lower seal ring groove 31F may also be disposed on the base plate 33A of the upper fixed scroll 33 and the base plate 34A of the lower fixed scroll 34 facing the bulb portion 31A.

The invention claimed is:

1. A scroll compressor comprising:

a main shaft;

an orbiting scroll that has a spiral tooth on each of first and second surfaces;

first and second fixed scrolls that respectively face said first and second surfaces of said orbiting scroll and that have spiral teeth that intermesh with said spiral teeth of said orbiting scroll;

tip seals mounted only on said spiral tooth of said first fixed scroll and on said spiral tooth on said first surface of said orbiting scroll;

a sealed vessel accommodating said orbiting scroll and said first and second fixed scrolls, wherein pressure inside said sealed vessel is equal to an intake pressure; and seal ring grooves containing seal rings that seal said orbiting scroll and said first and second fixed scrolls, said seal ring grooves being located on said orbiting scroll or on said first and second fixed scrolls, wherein said seal ring groove containing said seal ring sealing said first fixed scroll has an inside diameter that is smaller than inside diameter of said seal ring groove and said seal ring sealing said second fixed scroll.

2. The scroll compressor according to claim 1, wherein a first compression chamber defined by said orbiting scroll and said first fixed scroll has a first cross-sectional area, in a direction perpendicular to said main shaft, a second compression chambers defined by said orbiting scroll and second fixed scroll, having a second cross-sectional area, in the direction perpendicular to said main shaft, and said first cross-sectional area is larger than said second cross-sectional area whereby a thrust load is applied to said orbiting scroll in a direction from said first fixed scroll towards said second fixed scroll.

3. The scroll compressor according to claims 2, wherein said spiral tooth on said first surface of said orbiting scroll has a thickness that is larger than the thickness of said spiral tooth on said second surface of said orbiting scroll.

4. The scroll compressor according to claim 2, wherein said spiral tooth on said first surface of said orbiting scroll has a larger number of turns than said spiral tooth on said second surface of said orbiting scroll.

5. The scroll compressor according to claim 1, wherein carbon dioxide is compressed.

* * * * *